US010167771B2

(12) United States Patent
Kobayashi

(10) Patent No.: US 10,167,771 B2
(45) Date of Patent: Jan. 1, 2019

(54) EBULLIENT COOLING DEVICE

(71) Applicant: TOYOTA JIDOSHA KABUSHIKI KAISHA, Toyota-shi, Aichi-ken (JP)

(72) Inventor: Hideo Kobayashi, Mishima (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 11 days.

(21) Appl. No.: 15/323,449

(22) PCT Filed: Jul. 3, 2015

(86) PCT No.: PCT/JP2015/069326

§ 371 (c)(1),
(2) Date: Jan. 3, 2017

(87) PCT Pub. No.: WO2016/006558

PCT Pub. Date: Jan. 14, 2016

(65) Prior Publication Data

US 2017/0145895 A1 May 25, 2017

(30) Foreign Application Priority Data

Jul. 7, 2014 (JP) ..... 2014-139950

(51) Int. Cl.
*F01P 7/14* (2006.01)
*F01P 3/22* (2006.01)
(Continued)

(52) U.S. Cl.
CPC ..... *F01P 7/14* (2013.01); *F01K 23/06* (2013.01); *F01K 23/065* (2013.01); *F01K 23/10* (2013.01);
(Continued)

(58) Field of Classification Search
CPC ..... F01P 7/14; F01P 3/20; F01P 2007/146; F28D 15/0266; F28D 15/06; F28D 21/0003; F28D 2015/0291; F28F 2250/06
See application file for complete search history.

(56) References Cited

U.S. PATENT DOCUMENTS

2001/0027663 A1* 10/2001 Zeigler ..... B60H 1/00007 62/406
2008/0202722 A1* 8/2008 Feuerecker ..... B60H 1/00907 165/41
(Continued)

FOREIGN PATENT DOCUMENTS

JP 2004019561 A * 1/2004
JP 2010-209882 A 9/2010
(Continued)

*Primary Examiner* — Jacob Amick
*Assistant Examiner* — Charles Brauch
(74) *Attorney, Agent, or Firm* — Sughrue Mion, PLLC

(57) ABSTRACT

An ebullient cooling device includes: a coolant passage configured to be formed inside an internal-combustion engine, and allow a coolant that cools the internal-combustion engine by boiling to flow therethrough; an expander configured to be driven by the coolant that has boiled in the internal-combustion engine; a condenser configured to be located at a downstream side of the expander, and cool the coolant that has passed through the expander; and a heat exchanger configured to cool a cooling object by heat exchange with the coolant, wherein a low-pressure region including the expander and the condenser and a high-pressure region other than the low-pressure region are formed in a path through which the coolant circulates, and a passage connecting to a part through which a liquid-phase coolant flows and a passage connecting to the low-pressure region are coupled to the heat exchanger.

5 Claims, 6 Drawing Sheets

(51) Int. Cl.

| | |
|---|---|
| ***F01P 7/16*** | (2006.01) |
| ***F01K 23/06*** | (2006.01) |
| ***F02G 5/00*** | (2006.01) |
| ***F01P 3/20*** | (2006.01) |
| ***F28D 15/02*** | (2006.01) |
| ***F28D 15/06*** | (2006.01) |
| ***F28D 21/00*** | (2006.01) |
| ***F01K 23/10*** | (2006.01) |

(52) U.S. Cl.

CPC ..... *F01K 23/101* (2013.01); *F01P 3/20* (2013.01); *F01P 3/22* (2013.01); *F01P 7/16* (2013.01); *F02G 5/00* (2013.01); *F28D 15/0266* (2013.01); *F28D 15/06* (2013.01); *F28D 21/0003* (2013.01); *F01P 2007/146* (2013.01); *F28D 2015/0291* (2013.01); *F28F 2250/06* (2013.01)

(56) References Cited

U.S. PATENT DOCUMENTS

| | | | | |
|---|---|---|---|---|
| 2009/0320477 | A1* | 12/2009 | Juchymenko ..... | F01K 23/065<br>60/651 |
| 2011/0100307 | A1* | 5/2011 | Moffat ..... | F01P 3/12<br>123/41.1 |

FOREIGN PATENT DOCUMENTS

| | | | | |
|---|---|---|---|---|
| JP | 2010-223116 | A | | 10/2010 |
| JP | 2011-149386 | A | | 8/2011 |
| JP | 2011-202584 | A | | 10/2011 |
| JP | 2012102644 | A | * | 5/2012 |
| JP | 2012102644 | A | * | 5/2012 |

* cited by examiner

EBULLIENT COOLING DEVICE

CROSS REFERENCE TO RELATED APPLICATIONS

This application is a National Stage of International Application No. PCT/JP2015/069326 filed Jul. 3, 2015, claiming priority based on Japanese Patent Application No. 2014-139950 filed Jul. 7, 2014, the contents of all of which are incorporated herein by reference in their entirety.

TECHNICAL FIELD

The present invention relates to an ebullient cooling device.

BACKGROUND ART

There have been known, as cooling devices of internal-combustion engines, ebullient cooling devices that cool the internal-combustion engine with the heat of vaporization by boiling of the coolant flowing through a coolant passage (e.g., a water jacket) formed inside the internal-combustion engine. For example, Patent Document 1 suggests combining such an ebullient cooling device with a Rankine cycle.

PRIOR ART DOCUMENT

Patent Document

[Patent Document 1] Japanese Patent Application Publication No. 2010-223116

SUMMARY OF THE INVENTION

Problems to be Solved by the Invention

To efficiently use an expander such as a turbine included in a Rankine cycle, the pressure at the upstream side of the expander is desired to be high, and is required to be the atmospheric pressure or greater. That is, to improve the efficiency of the Rankine cycle that uses vapor obtained by ebullient cooling of the internal-combustion engine, the pressure at the internal-combustion engine side is also increased. As a working fluid of the internal-combustion engine, i.e., a coolant, selected is, for example, water, an LLC (long life coolant), or ethyl alcohol, which has a boiling point close to that of water. When water is selected as a coolant, the boiling temperature of the coolant is 100° C. at 1 atmosphere, and 120° C. at 2 atmospheres. In the internal-combustion engine, various types of cooling with a coolant such as a lubricating oil or a transmission oil may be perforated. For example, the temperature of the lubricating oil circulating through the internal-combustion engine is generally higher than that of the coolant by about 10 to 30° C. Thus, when the lubricating oil is to be cooled by heat exchange with the coolant, the temperature of the lubricating oil never becomes equal to or less than the temperature of the coolant with high temperature, and the lubricating oil may thus deteriorate, or the sliding portion of the internal-combustion engine may seize.

Thus, the ebullient cooling device disclosed in the present specification aims to appropriately cool a cooling object to be cooled by heat exchange with a coolant that cools an internal-combustion engine.

Means for Solving the Problems

To achieve the above aim, an ebullient cooling device disclosed in the present specification includes: a coolant passage configured to be formed inside an internal-combustion engine, and to allow a coolant that cools the internal-combustion engine by boiling to flow therethrough; an expander configured to be driven by the coolant that has boiled in the internal-combustion engine; a condenser configured to be located at a downstream side of the expander, and to cool the coolant that has passed through the expander; and a heat exchanger configured to cool a cooling object by heat exchange with the coolant, wherein a low-pressure region including the expander and the condenser and a high-pressure region other than the low-pressure region are formed in a path through which the coolant circulates, and a passage connecting to a part through which a liquid-phase coolant flows and a passage connecting to the low-pressure region are coupled to the heat exchanger. Connecting the heat exchanger to the low-pressure region causes a state where ebullient cooling easily occurs in the heat exchanger. Thus, the heat exchanger is made to be in the ebullient cooling state, and the cooling object can be appropriately cooled even while a Rankine cycle is utilized.

The ebullient cooling device may further include a flow control valve configured to adjust an amount of the liquid-phase coolant that flows through the passage coupled to the heat exchanger and the part through which the liquid-phase coolant flows, the flow control valve being located in the passage. The provision of the flow control valve allows the amount of the coolant in the heat exchanger to be adjusted and facilitates ebullient cooling in the heat exchanger.

The ebullient cooling device may further include: a passage configured to diverge from the passage connecting to the low-pressure region and to be communicated with the coolant passage formed inside the internal-combustion engine; and a control valve configured to switch between a state where a passage leading to the low-pressure region is opened and a state where a passage leading to the coolant passage formed inside the internal-combustion engine is opened, the control valve being located in a point at which the passage diverges from the passage connecting to the low-pressure region. This configuration allows for switching between an ebullient cooling state in which latent heat of vaporization by boiling of the coolant is utilized and a liquid cooling state in which cooling is performed by taking heat by a liquid-phase coolant.

The ebullient cooling device may switch the control valve to the state where the passage leading to the coolant passage formed inside the internal-combustion engine is opened during warm-up of the internal-combustion engine. The cooling object can be warmed up early by causing the cooling state to be the liquid cooling state during warm-up of the internal-combustion to use the coolant of which the temperature increases more easily than that of the cooling object during the warm-up of the internal-combustion engine.

The ebullient cooling device may switch the control valve to the state where the passage leading to the coolant passage formed inside the internal-combustion engine is opened when the internal-combustion engine is in a high-rotation state or a high-load state. Accordingly, the operation of the Rankine cycle is stopped and the liquid cooling in the internal-combustion engine and the heat exchanger is performed when the internal-combustion engine is in the high-rotation state or the high-load state. While the Rankine cycle is stopped, the pressure of the coolant decreases, and the boiling point also decreases. Thus, the temperature of the coolant also decreases, and the cooling object can be thereby appropriately cooled.

The ebullient cooling device may further include: a bypass passage configured to diverge from a path connecting the coolant passage formed inside the internal-combustion engine and the expander, and to bypass the expander and connect to the condenser; and a control valve configured to switch between a state where a passage leading to the expander is opened and a state where the bypass passage is opened, the control valve being located at a point at which the bypass passage diverges from the path connecting the coolant passage and the expander. When the ebullient cooling state is selected, the flow of vapor into the bypass passage can be avoided, and when the liquid cooling state is selected, the coolant can be cooled by sending the liquid-phase coolant to the condenser.

Effects of the Invention

The ebullient cooling device disclosed in the present specification can cool a cooling object to be cooled by heat exchange with a coolant that cools an internal-combustion engine.

MODES FOR CARRYING OUT THE INVENTION

Figure 1:
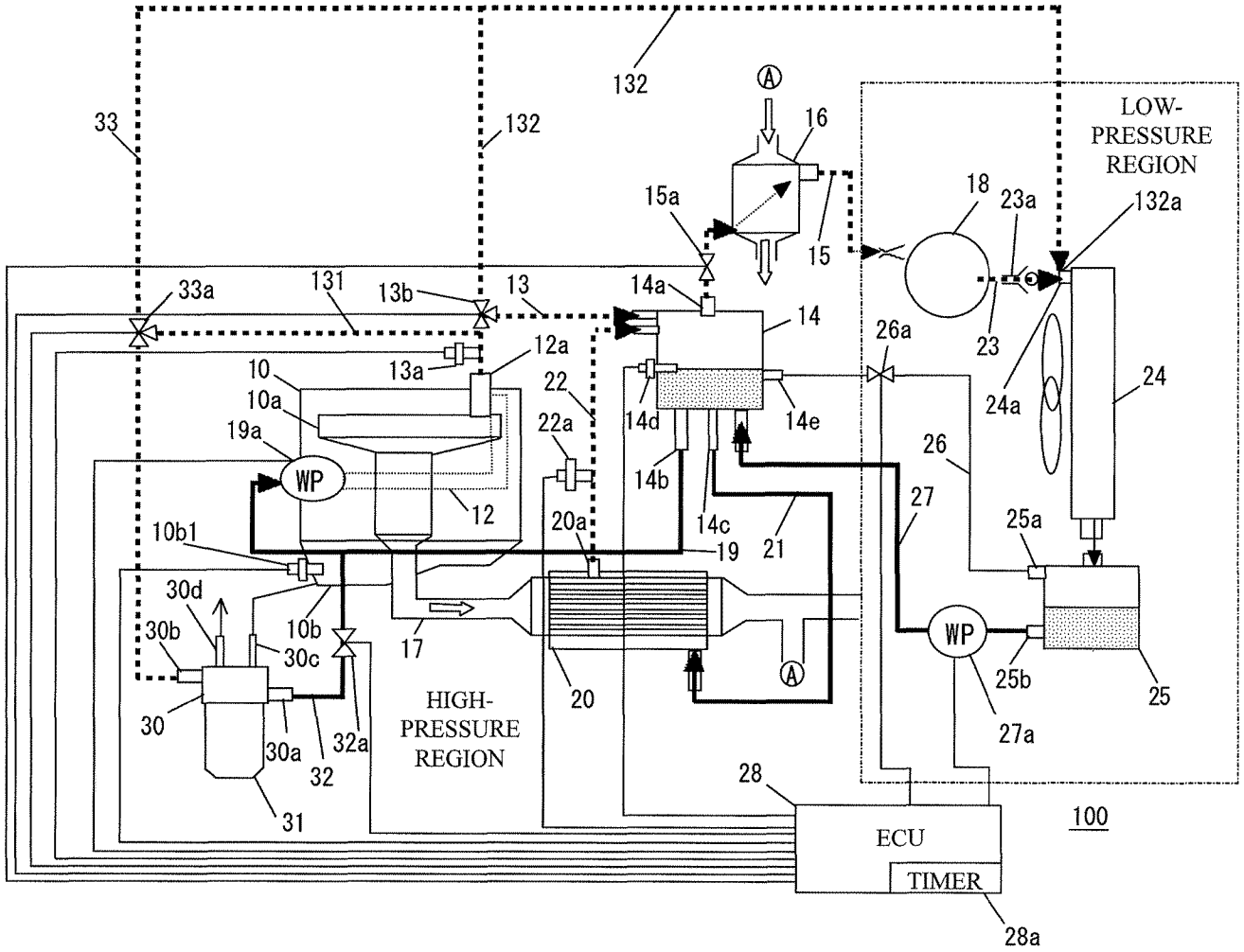
FIG. 1 is an explanatory diagram illustrating an overall configuration of an ebullient cooling device of an embodiment.

Hereinafter, an embodiment of the present invention will be described with reference to the accompanying drawings. However, in the drawings, the dimensions of each part, ratios, and the like may not completely correspond to actual ones. In addition, the specifics may be omitted in some drawings.

(Embodiment)

With reference to FIG. 1, a description will first be given of an ebullient cooling device 100 of an embodiment built in an internal-combustion engine 10. FIG. 1 is an explanatory diagram illustrating an overall configuration of the ebullient cooling device 100 of the embodiment. The internal-combustion engine 10 includes an intake system and an exhaust system, and the exhaust system includes an exhaust manifold 10*a*. The internal-combustion engine 10 includes an oil pan 10*b*. The oil pan 10*b* is equipped with an oil temperature sensor 10*b*1. The oil temperature sensor 10*b*1 detects the temperature of the oil stored in the oil pan 10*b*. The ebullient cooling device 100 includes a coolant passage 12 that is formed inside the internal-combustion engine 10 and through which a coolant that cools the internal-combustion engine 10 by boiling flows. The coolant passage 12 is, for example, a water jacket that is formed around the cylinder of the internal-combustion engine 10, but may have other configuration as long as it can cool the internal-combustion engine 10 by the coolant in the coolant passage 12. The coolant flowing through the coolant passage 12 absorbs the heat of the internal-combustion engine 10 and boils, thereby cooling the internal-combustion engine 10. The coolant flowing through the coolant passage 12 is not specifically limited as long as it is a liquid that absorbs the heat of the internal-combustion engine 10 and boils, such as water, an LLC (long life coolant), ethyl alcohol, or the like. The present embodiment uses a coolant formed of a mixture of water and ethylene glycol. The ebullient cooling device 100 can achieve two cooling states: an ebullient cooling state in which the internal-combustion engine 10 is cooled by boiling of the coolant flowing through the coolant passage 12; and a liquid cooling state in which the internal-combustion engine 10 is cooled by removing heat by the liquid-phase coolant. When the ebullient cooling device 100 is in the ebullient cooling state, a Rankine cycle, in which exhaust heat is recovered by using generated vapor, is formed. When the pressure in the region through which the coolant flows decreases, the coolant easily boils, and the ebullient cooling device 100 easily shifts to the ebullient cooling state. On the contrary, when the pressure in the region through which the coolant flows increases, the coolant has difficulty in boiling, and the ebullient cooling device 100 easily shifts to the liquid cooling state.

The coolant passage 12 has an outlet 12*a* located in the cylinder head of the internal-combustion engine 10, and the outlet 12*a* connects to a first passage 13. The first passage 13 is equipped with a first temperature sensor 13*a*. The first temperature sensor 13*a* measures the temperature of the coolant flowing through the first passage 13. The other end of the first passage 13 is connected to a gas-liquid separator 14. The coolant flowing through the first passage 13 is mainly a gas-phase coolant that has vapored in the coolant passage 12, but may contain a liquid-phase coolant.

The gas-liquid separator 14 includes a steam outlet 14*a*. The steam outlet 14*a* connects to a fourth passage 15. Vapor that has passed through the gas-liquid separator 14 flows into the fourth passage 15. A turbine 18, which is an example of an expander, is located at the other end of the fourth passage 15. A superheater 16 is located between the gas-liquid separator 14 and the turbine 18 in the fourth passage 15. The superheater 16 is provided with an exhaust gas that has passed through an exhaust heat steam generator 20 described later, thereby further applying heat to the vapor that has passed through the gas-liquid separator 14. The turbine 18 is driven by superheated steam that flows from the superheater 16 thereinto. The turbine 18 connects to, for example, a power generator that generates power by using the driving force of the turbine 18. This configuration allows for the recovery of the exhaust heat of the internal-combustion engine 10. The driving force of the turbine 18 may be used to assist the driving force of the internal-combustion engine 10. As described above, the ebullient cooling device 100 of the present embodiment also functions as a Rankine cycle. The superheater 16 and the exhaust heat steam generator 20 may be reversed with respect to the flow path of the exhaust gas. That is, with respect to the flow path of the exhaust gas, the superheater 16 may be located further upstream than the exhaust heat steam generator 20 to allow the exhaust gas that has passed through the superheater 16 to be introduced into the exhaust heat steam generator 20.

A second passage 131 diverges from the first passage 13. The other end of the second passage 131 connects to a thirteenth passage 33 described later. A third passage 132 diverges from the first passage 13 further downstream than the point at which the second passage 131 diverges. The other end 132*a* of the third passage 132 is connected to an inlet 24*a* of a condenser (hereinafter, described as a CDN in some cases) 24 described later. The third passage 132 functions as a bypass passage that bypasses the turbine 18 described later. That is, the third passage 132 is a bypass passage that diverges from the path 13 and the path 15, which connect the coolant passage 12 formed inside the internal-combustion engine 10 and the turbine 18, and bypasses the turbine 18 to connect to the condenser 24. A first three-way valve 13*b* is located at the point at which the third passage 132 diverges from the first passage 13. The first three-way valve 13*b* corresponds to a control valve that switches between a state in which a passage leading to the turbine 18 is opened and a state in which the third passage 132, which is the bypass passage, is opened. Accordingly, the first three-way valve 13*b* causes the coolant discharged from the outlet 12*a* of the coolant passage 12 to pass through the first passage 13 and be introduced into the gas-liquid separator 14 or causes the coolant to pass through the third passage 132 to bypass the turbine 18 and be introduced into the condenser 24. The first three-way valve 13*b* is a magnetic valve, and is electrically coupled to an ECU 28 corresponding to a controller.

As described above, the gas-liquid separator 14 located between the internal-combustion engine 10 and the turbine 18 separates the coolant discharged from the internal-combustion engine 10 into a liquid-phase coolant and a gas-phase coolant. The gas-liquid separator 14 stores the resultant liquid-phase coolant in the lower side thereof. A first on-off valve 15*a* is located between the steam outlet 14*a* of the gas-liquid separator 14 and the superheater 16. The first on-off valve 15*a* is a magnetic valve, and is electrically coupled to the ECU 28 corresponding to the controller. When the first on-off valve 15*a* is closed, the discharge of vapor from the gas-liquid separator 14 is stopped. Located at the lower end of the gas-liquid separator 14 are a first liquid-phase coolant outlet 14*b* and a second liquid-phase coolant outlet 14*c*. The first liquid-phase coolant outlet 14*b* connects to a fifth passage 19. Since the separated liquid-phase coolant is stored in the lower end of the gas-liquid separator 14, the liquid-phase coolant always flows through the fifth passage 19. A first water pump (WP) 19*a* is located in the fifth passage 19. The first water pump 19*a* supplies the liquid-phase coolant to the coolant passage 12 formed inside the internal-combustion engine 10. The second liquid-phase coolant outlet 14*c* connects to a sixth passage 21. The liquid-phase coolant also always flows through the sixth passage 21 as well as the fifth passage 19. The other end of the sixth passage 21 is connected to the exhaust heat steam generator 20, and supplies the liquid-phase coolant to the exhaust heat steam generator 20. The exhaust heat steam generator 20 will be described later.

The gas-liquid separator 14 includes a fluid level sensor 14*d* that measures the level of fluid, i.e., the level of the stored liquid-phase coolant thereinside. The fluid level sensor 14*d* is electrically coupled to the ECU 28. The gas-liquid separator 14 includes an outlet 14*e* that discharges the liquid-phase coolant. As described later, the outlet 14*e* connects to a ninth passage 26. The diameter and the installation location of the outlet 14*e* are configured to be suitable for the level of the fluid to be controlled with the fluid level sensor 14*d*. That is, the specifications of the outlet 14*e* are configured so that the level of the fluid to be controlled with the fluid level sensor 14*d*, in other words, so that the upper limit fluid level and the lower limit fluid level can be achieved. If the outlet 14*e* is configured to be located extremely higher than a desired fluid level, the liquid-phase coolant inside the gas-liquid separator 14 fails to be properly discharged. As a result, the volume of the gas-liquid separator 14 needs to be configured to be large. On the contrary, if the outlet 14*e* is configured to be located extremely lower than the desired fluid level, the liquid-phase coolant is discharged too much. This may cause the lack of the liquid-phase coolant to be supplied to the internal-combustion engine 10, causing insufficient cooling of the internal-combustion engine 10. The specifications of the outlet 14*e* are determined taking into consideration at least the above conditions. The gas-liquid separator 14 is also configured to be located at a position at which the liquid-phase coolant is supplied to the first water pump 19*a* and the exhaust heat steam generator 20 by gravity.

As described above, the ebullient cooling device 100 of the present embodiment includes the exhaust heat steam generator 20. The exhaust heat steam generator 20 is located near an exhaust pipe 17 coupled to the exhaust manifold 10*a* of the internal-combustion engine 10. The exhaust heat steam generator 20 utilizes the exhaust heat of the internal-combustion engine 10 discharged through the exhaust pipe 17 to generate vapor. This configuration makes efficient use of the exhaust heat of the internal-combustion engine 10. The exhaust heat steam generator 20 is not essential for cooling the internal-combustion engine 10, but can improve the efficiency of the exhaust heat recovery of the device as a whole.

The exhaust heat steam generator 20 includes an outlet 20*a*. The outlet 20*a* connects to a seventh passage 22. The seventh passage 22 is equipped with a second temperature sensor 22*a*. The second temperature sensor 22*a* measures the temperature of the coolant flowing through the seventh passage 22. The other end of the seventh passage 22 is coupled to the gas-liquid separator 14. The coolant flowing through the seventh passage 22 is mainly a gas-phase coolant vaporized in the exhaust heat steam generator 20, but may contain a liquid-phase coolant together. As described above, the gas-liquid separator 14 separates not only the coolant boiled in the internal-combustion engine 10, but also the coolant discharged from the exhaust heat steam generator 20 into a liquid-phase coolant and a gas-phase coolant.

The ebullient cooling device 100 includes, at the downstream side of the turbine 18, the condenser 24 that cools the gas-phase coolant that has passed through the turbine 18 to produce the liquid-phase coolant. That is, the condenser 24 is located further downstream than the turbine 18, and cools the coolant that has passed through the turbine 18. The condenser 24 also cools the coolant that has passed through the third passage 132 that is the bypass passage. When the ebullient cooling device 100 is in the liquid cooling state, the liquid-phase coolant is cooled. The condenser 24 connects to the other end of an eighth passage 23 located at the downstream side of the turbine 18. The condenser 24 is a heat exchanger, exchanges heat with the coolant, and returns the gas-phase coolant into the liquid-phase coolant by cooling the coolant. When the ebullient cooling device 100 is in the liquid cooling state, the condenser 24 cools the liquid-phase coolant as a radiator installed in a general vehicle does. A unidirectional valve 23*a* is located in the eighth passage 23, preventing vapor from flowing back from the condenser 24 to the turbine 18.

The ebullient cooling device 100 includes a catch tank 25 that stores the liquid-phase coolant that has been cooled by the condenser 24, i.e., the coolant that has been returned to the liquid-phase coolant from the gas-phase coolant. The catch tank 25 includes a coolant inlet 25*a* at the upper side, and a coolant outlet 25*b* at the lower side. The coolant inlet 25*a* connects to the ninth passage 26 that discharges the liquid-phase coolant in the gas-liquid separator 14 to the catch tank 25. That is, the ninth passage 26 is coupled to the outlet 14*e* of the gas-liquid separator 14. A second on-off valve 26*a* is located in the ninth passage 26. The second on-off valve 26*a* is a magnetic valve and is electrically coupled to the ECU 28. The coolant outlet 25*b* connects to a tenth passage 27 that supplies the liquid-phase coolant in the catch tank 25 to the gas-liquid separator 14. A second water pump (WP) 27*a* is located in the tenth passage 27. The second water pump 27*a* is an electric pump, is electrically coupled to the ECU 28, and is controlled by the ECU 28 based on the measurement value of the fluid level sensor 14*d*. A displacement pump is employed for the second water pump 27*a*.

The above-described ebullient cooling device 100 can separate the path through which the coolant circulates into a low-pressure region including the turbine 18 and the condenser 24 and a high-pressure region other than the low-pressure region. More specifically, high-pressure vapor flows through the passage from the coolant passage 12 to the inlet of the turbine 18, i.e., the first passage 13 and the fourth passage 15, and the pressure of the vapor gradually decreases by passing through the turbine 18. Thus, the region containing the turbine 18 through the condenser 24 is included in the low-pressure region in which the pressure is low. At the downstream side of the condenser 24 and the catch tank 25, the second water pump 27*a* pumps the coolant toward the gas-liquid separator 14 and further toward the internal-combustion engine 10. Thus, the downstream side of the condenser 24 and the catch tank 25 is included in the high-pressure region.

The ebullient cooling device 100 includes an oil cooler (hereinafter, referred to as an EOC in some cases) 30, which is an example of a heat exchanger. The oil cooler 30 cools a lubricating oil, which is a cooling object, by exchanging heat with the coolant. The oil cooler 30 connects to an oil filter 31. The oil cooler 30 includes a first mouth 30*a* and a second mouth 30*b* . Inside the oil cooler 30, the coolant flows through a passage connecting the first mouth 30*a* and the second mouth 30*b*. The first mouth 30*a* connects to a twelfth passage 32. The twelfth passage 32 diverges from the fifth passage 19. More specifically, the twelfth passage 32 diverges from the fifth passage 19 between the gas-liquid separator 14 and the first water pump 19*a*. The first mouth 30*a* is required to connect to a point through which the liquid-phase coolant always flows. Additionally, taking into consideration that the ebullient cooling device 100 becomes in the liquid cooling state and the coolant flowing through the oil cooler 30 is also circulated by the first water pump 19*a*, the twelfth passage 32 preferably diverges further upstream than the water pump 19*a* of the fifth passage 19. A flow control valve 32*a* is located in the twelfth passage 32. The flow control valve 32*a* adjusts the amount of the liquid-phase coolant flowing through the twelfth passage 32. That is, the flow control valve 32*a* adjusts the amount of the liquid-phase coolant introduced into the oil cooler 30 through the first mouth 30*a*. The flow control valve 32*a* is a magnetic valve and electrically coupled to the ECU 28 corresponding to the controller.

The second mouth 30*b* connects to the thirteenth passage 33. The other end of the thirteenth passage 33 connects to the inlet 24*a* of the condenser 24. More specifically, the other end of the thirteenth passage 33 joins the third passage 132, thereby connecting to the inlet 24*a* of the condenser 24. Thus, the thirteenth passage 33 is coupled to the low-pressure region. The first mouth 30*a* and the second mouth 30*b* may function as the inlet or outlet for the coolant depending on the flow direction of the coolant. For example, when the ebullient cooling device 100 is in the ebullient cooling state, the first mouth 30*a* serves as an inlet and the second mouth 30*b* serves as an outlet. On the other hand, when the ebullient cooling device 100 is in the liquid cooling state, the second mouth 30*b* serves as an inlet, and the first mouth 30*a* serves as an outlet.

The thirteenth passage 33 connects to the second passage 131 diverging from the first passage 13. That is, the second passage 131 is a passage that diverges from the thirteenth passage 33 and is communicated with the coolant passage 12 formed inside the internal-combustion engine 10. At the point at which the second passage 131 connects to the thirteenth passage 33, in other words, the point at which the thirteenth passage 33 diverges from the second passage 131, located is a second three-way valve 33*a*. The second three-way valve 33*a* corresponds to a control valve configured to switch between a state where a passage leading to the low-pressure region is opened and a state where a passage leading to the coolant passage 12 formed inside the internal-combustion engine 10 is opened. Accordingly, the second three-way valve 33*a* couples the second mouth 30*b* to the outlet 12*a* of the coolant passage 12 or to the inlet 24*a* of the condenser 24. The second three-way valve 33*a* is a magnetic valve and electrically coupled to the ECU 28 corresponding to the controller.

The oil cooler 30 includes an oil inlet 30*c* and an oil outlet 30*d*. The oil inlet 30*c* connects to the oil pan 10*b*, and introduces the oil in the oil pan 10*b* into the oil cooler 30. The oil outlet 30*d* is coupled to an oil passage that supplies the oil to parts necessary to be supplied with the oil in the internal-combustion engine 10. The oil can be cooled by the above-described oil cooler 30.

In the present embodiment, the oil cooler 30 cooling the lubricating oil is assumed to be a heat exchanger, but a cooler of which the cooling object is, for example, ATF (Automatic Transmission Fluid) or mission oil may be the heat exchanger.

The ebullient cooling device 100 includes the ECU 28 as the controller. The ECU 28 is coupled to various sensors, various on-off valves, and the like, and controls the operation of each part. The control of the ECU 28 is executed by the cooperation between hardware including a CPU (Central Processing Unit) and software stored in a ROM (Read Only Memory) or the like. The ECU 28 includes a timer 28*a*. The timer 28*a* measures time in an example of the control described later.

Figure 2:
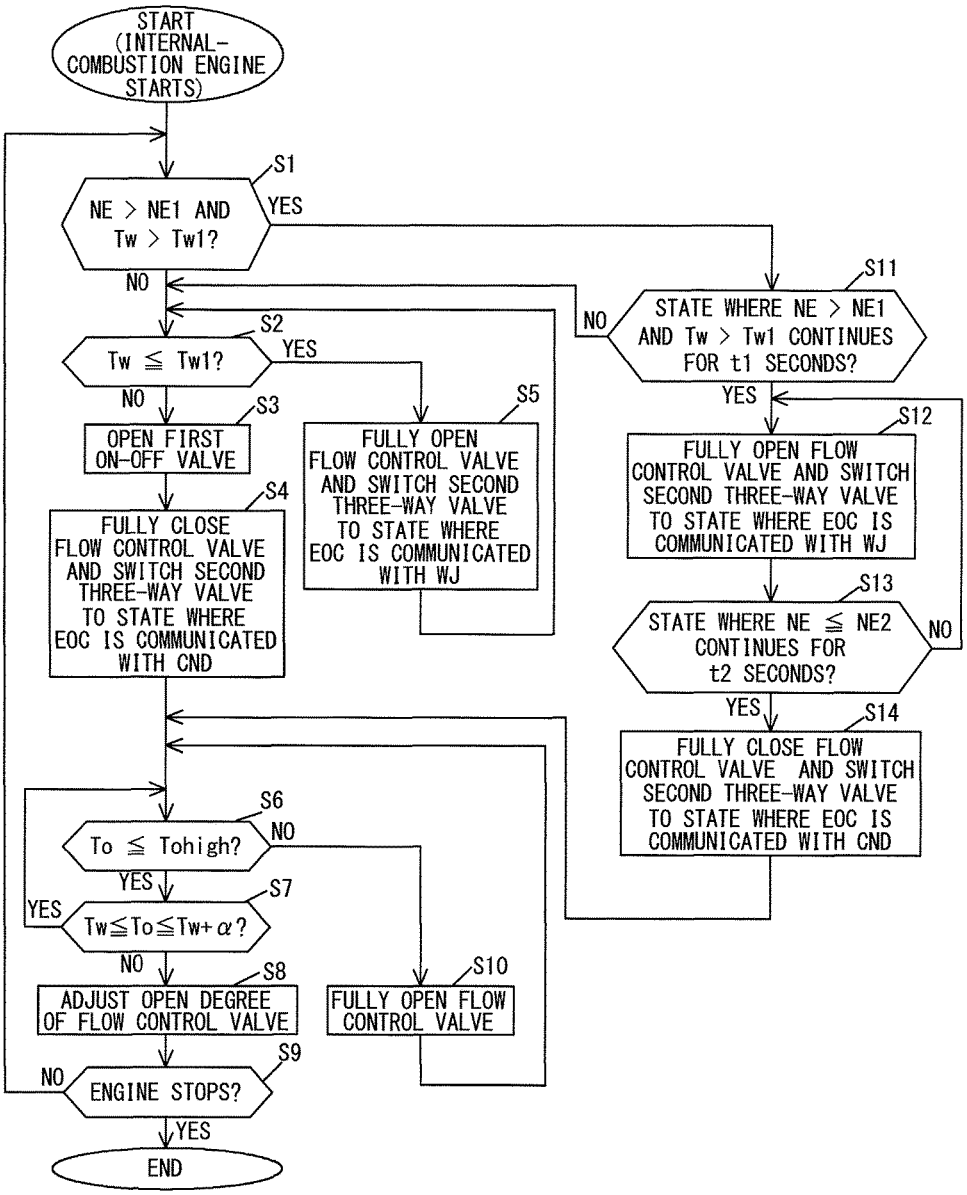
FIG. 2 is a flowchart of a control of the ebullient cooling device of the embodiment.

The following will describe an example of the control executed in the ebullient cooling device 100 with reference to FIG. 2. FIG. 2 is a flowchart illustrating an example of the control of the ebullient cooling device 100 of the embodiment. The control executed in the ebullient cooling device 100 is schematically described as follows. First, during the warm-up, the internal-combustion engine 10 switches the second three-way valve 33*a* to the state where the passage leading to the coolant passage 12 formed inside the internal-combustion engine 10 is opened. When the internal-combustion engine 10 is in a high-rotation state or a high-load state, the second three-way valve 33*a* is also switched to the state where the passage leading to the coolant passage 12 formed inside the internal-combustion engine 10 is opened. In the cases other than these cases, the second three-way valve 33*a* is made to be in the state where the passage leading to the low-pressure region is opened. Hereinafter, an example of the control will be described in detail.

First, when the ignition of the internal-combustion engine 10 is turned ON, and the internal-combustion engine 10 is started, a sequence of the control starts. At step S1, it is determined whether the rotation speed NE of the internal-combustion engine is greater than a high rotation determination threshold value NE1 and the temperature Tw of the coolant is greater than a warm-up determination temperature Tw1. At step S1, it is determined which control is to be mainly executed: the control for cold start executed from step S2; or the control, executed from step S11, for restart of the internal-combustion engine. Here, it is assumed that the internal-combustion engine 10 is restarted when the internal-combustion engine in operation once stops and starts again. More specifically, it is assumed that the internal-combustion engine is restarted when the internal-combustion engine 10 completes the warm-up and stops, and thereafter starts again before cooled. Additionally, even when the internal-combustion engine 10 does not once stop, if the predetermined conditions to be determined at step S1 is met, the processes from step S11 are executed. The ebullient cooling device 100 of the present embodiment switches between the ebullient cooling state and the liquid cooling state, and the high-rotation determination threshold value NE1 is a threshold value for the liquid cooling state to be selected. Additionally, the warm-up determination temperature Tw1 is a threshold value for determining whether the warm-up of the internal-combustion engine 10 has been completed. The temperature Tw of the coolant is obtained by the first temperature sensor 13*a*.

Figure 3:
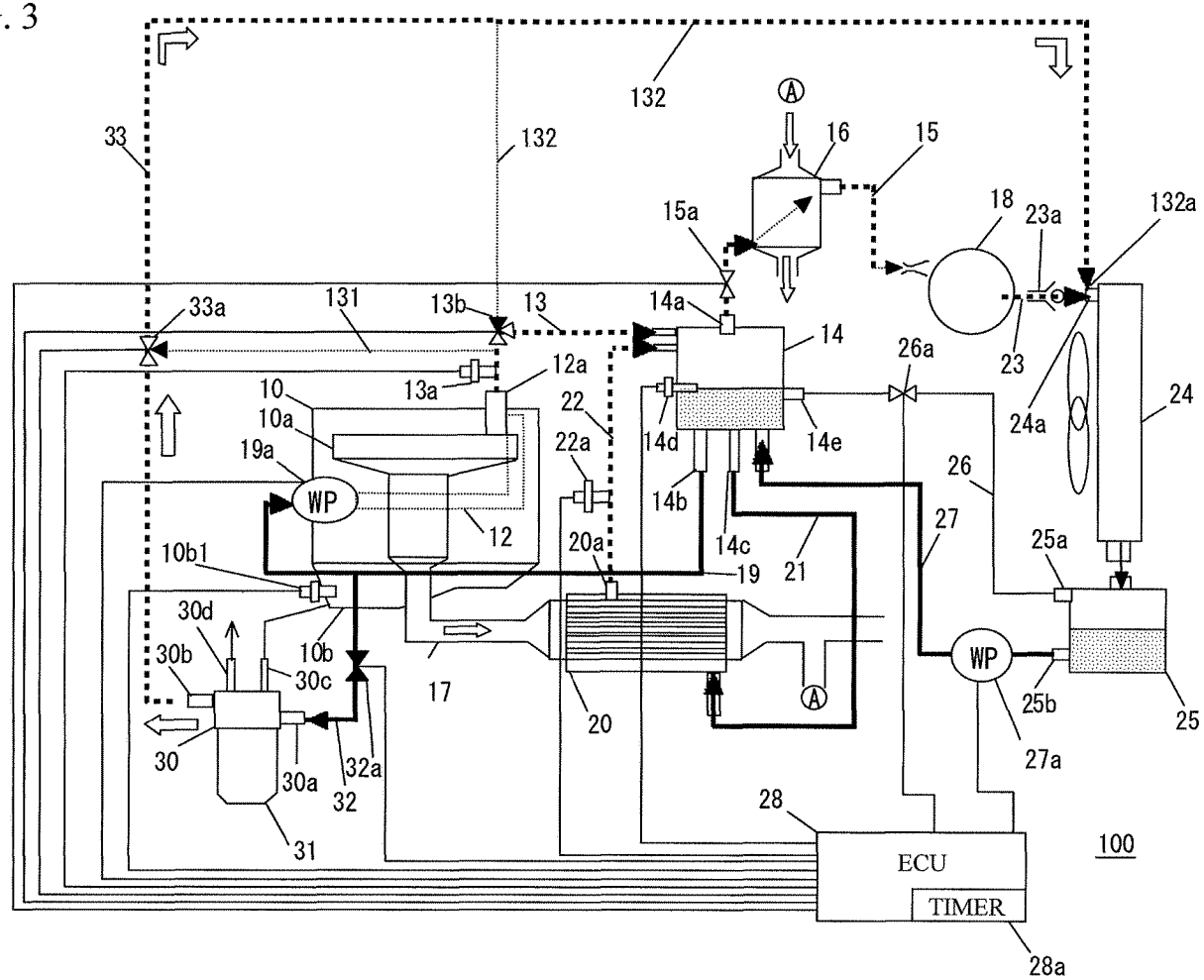
FIG. 3 is an explanatory diagram illustrating an overall configuration of the ebullient cooling device in an ebullient cooling state.

When the determination at step S1 is NO, that is, when at least one of the rotation speed NE of the internal-combustion engine 10 or the temperature Tw of the coolant fails to meet the predetermined condition, the process moves to step S2. At step S2, it is determined whether the temperature Tw of the coolant is equal to or less than the warm-up determination temperature Tw1. When the determination at step S2 is NO, that is, when it is determined that the warm-up of the internal-combustion engine 10 has been completed, the process moves to step S3. When the determination at step S2 is NO, it is determined that the warm-up of the internal-combustion engine 10 has been completed, and the ebullient cooling device 100 is made to be in the ebullient cooling state. When the ebullient cooling device 100 is in the ebullient cooling state, the internal-combustion engine 10 and the oil cooler 30 are cooled by ebullient cooling. At step S3, as illustrated in FIG. 3, the first on-off valve 15*a* is opened. At this time, as indicated by black fill in FIG. 3, the first three-way valve 13*b* closes the third passage 132, which is the bypass passage, and opens the first passage 13 leading to the gas-liquid separator 14. This control allows vapor gradually generated in the internal-combustion engine 10 to be sent to the gas-liquid separator 14. When the first on-off valve 15*a* is opened while the warm-up of the internal-combustion engine 10 is completed, the gas-phase coolant stored in the gas-liquid separator 14 and separated from the liquid-phase coolant is sent to the superheater 16. When the first on-off valve 15*a* is opened, the pressure at the upstream side of the gas-liquid separator 14 decreases, causing the state where more vapor is easily generated. Thus, continuously generated vapor is sent to the superheater 16. At step S4 subsequent to step S3, as illustrated in FIG. 3, the flow control valve 32*a* is fully closed. This control stops the flow of the liquid-phase coolant into the oil cooler (EOC) 30. Then, while the flow control valve 32*a* is closed, the state of the second three-way valve 33*a* is made to be a state where the oil cooler 30 is communicated with the condenser 24. That is, the oil cooler 30 is made to be coupled to the low-pressure region. This control decreases the pressure inside the oil cooler 30, causing low pressure boiling to occur inside the oil cooler 30 and ebullient cooling to be performed. At this time, since the flow control valve 32*a* is fully closed, and the amount of the coolant inside the oil cooler 30 easily decreases, the temperature of the oil cooler 30 is effectively decreased by ebullient cooling. At this time, as indicated by black fill in FIG. 3, the second three-way valve 33*a* closes the second passage 131. Accordingly, vapor generated in the internal-combustion engine 10 is sent to the gas-liquid separator 14 through the first passage 13 without joining the thirteenth passage 33. The processes of steps S3 and S4 may be simultaneously executed, or switched in order. After steps S3 and S4, the process moves to step S6.

Figure 4:
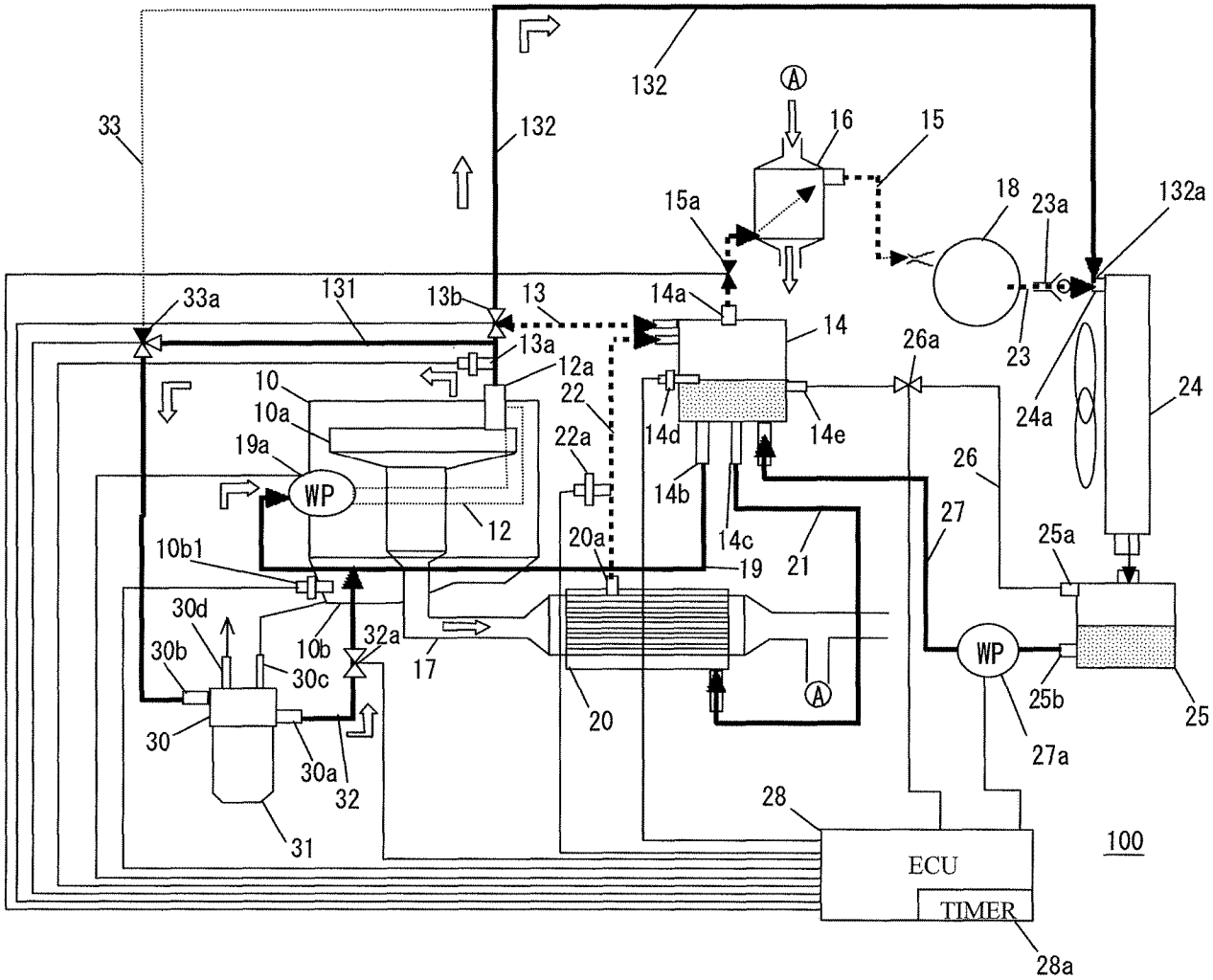
FIG. 4 is an explanatory diagram illustrating an overall configuration of the ebullient cooling device in a liquid cooling state.

On the other hand, when the determination at step S2 is YES, that is, when it is determined that the warm-up of the internal-combustion engine 10 has not been completed, the process moves to step S5. When the determination at step S2 is YES, it is determined that the warm-up of the internal-combustion engine 10 has not been completed, and the ebullient cooling device 100 is made to be in the liquid cooling state. Here, although it is referred to as the liquid cooling state for the convenience sake, it mainly aims to circulate the liquid-phase coolant in the internal-combustion engine 10 while the internal-combustion engine 10 is warmed up. As described above, while the internal-combustion engine 10 is warmed up, the liquid-phase coolant is made to pass through the oil cooler 30 as well as the coolant passage 12 formed inside the internal-combustion engine 10 to cool the lubricating oil by sensible heat. The liquid cooling state during the warm-up of the internal-combustion engine 10 allows for the heat exchange between the coolant of which the temperature increases more easily than that of the lubricating oil, which is a cooling object, and the lubricating oil. This helps the increase in temperature of the lubricating oil and early completion of the warm-up. At step S5, the flow control valve 32*a* is fully opened as illustrated in FIG. 4. This control allows the liquid-phase coolant to keep flowing into the oil cooler (EOC) 30. Then, while the flow control valve 32*a* is opened, the state of the second three-way valve 33*a* is made to be the state where the oil cooler 30 and the water jacket (WJ), i.e., the coolant passage 12 are communicated with each other. As described above, while the internal-combustion engine 10 is warmed up, the second three-way valve 33*a* corresponding to the control valve is switched to the state where the passage leading to the coolant passage 12 formed inside the internal-combustion engine 10 is opened. This control allows a circulation path of the liquid-phase coolant including the oil cooler 30 and the coolant passage 12 to be formed. That is, as illustrated in FIG. 4, the liquid-phase coolant flows through the circulation path including the oil cooler and the coolant passage 12 in a counterclockwise direction in FIG. 4. The liquid-phase coolant is circulated by the first water pump 19*a*. At this time, as indicated by black fill in FIG. 4, the first three-way valve 13*b* closes the first passage 13, and opens the third passage 132 that bypasses the gas-liquid separator 14 and the turbine 18. This control causes the liquid-phase coolant to flow into the condenser 24. At this time, the condenser 24 functions as a radiator, and cools the liquid-phase coolant. After the process at step S5 is ended, the processes from step S2 are repeated again.

After the process at step S4 is ended, the process moves to step S6. At step S6, it is determined whether the temperature To of the lubricating oil is equal to or less than an upper limit temperature Tohigh. The temperature To of the lubricating oil is obtained by the oil temperature sensor 10b1. The upper limit temperature Tohigh is stored in the memory in the ECU 28. The upper limit temperature Tohigh is defined as an oil temperature that ensures the performance of the lubricating oil. When the determination at step S6 is YES, the process moves to step S7. On the other hand, when the determination at step S6 is NO, the process moves to step S10. That is, when the temperature To of the lubricating oil is greater than the upper limit temperature Tohigh, the process moves to step S10. At step S10, the flow control valve 32*a* is fully opened. This control introduces the liquid-phase coolant into the oil cooler 30, facilitating the cooling of the lubricating oil. After the flow control valve 32*a* is fully opened at step S10, the flow control valve 32*a* is kept fully opened till the determination at step S6 becomes YES.

At step S7, it is determined whether the temperature To of the lubricating oil is equal to or greater than the temperature Tw of the coolant, and equal to or less than a temperature slightly higher than the temperature Tw, i.e., Tw+α. This condition is set to prevent the lubricating oil from removing heat from the coolant more than necessary. More specifically, when the temperature To of the lubricating oil is less than the temperature Tw of the coolant, the heat of the coolant is removed by the lubricating oil in the oil cooler 30. The heat removed in the oil cooler 30 is discarded in the condenser 24. That is, the heat of the coolant is discarded in the condenser 24. As a result, the amount of vapor generated by evaporation of the coolant decreases, and the turbine output thereby decreases. Accordingly, the determination at step S7 is performed to prevent the heat quantity of the coolant from being removed by the lubricating oil.

When the determination at step S7 is NO, the process moves to step S8. On the other hand, when the determination at step S7 is YES, it is determined that the temperature of the lubricating oil has not reached a proper temperature yet, and the processes from step S6 are repeated.

Figure 5:
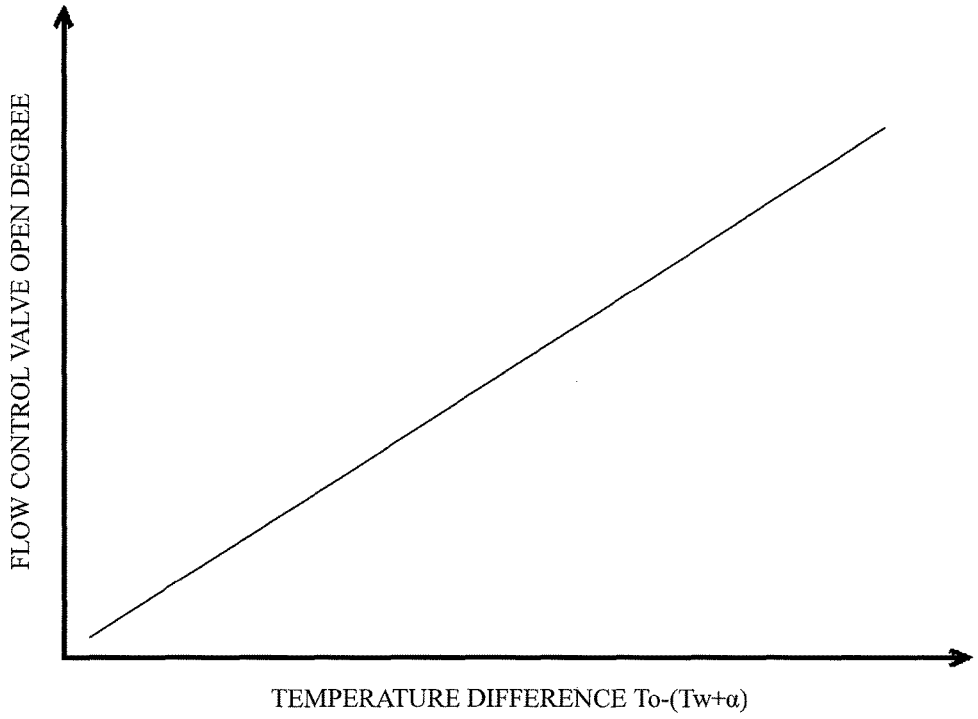
FIG. 5 illustrates a map used to determine an open degree of a flow control valve.

At step S8, the open degree of the flow control valve 32*a* is adjusted based on the difference between the temperature Tw+α of the coolant and the temperature To of the lubricating oil. More specifically, the open degree of the flow control valve 32*a* is adjusted by referring to a map illustrated in FIG. 5. As the difference between Tw+α and To increases, the open degree of the flow control valve 32*a* increases. Since the process at step S8 is performed when the determination at step S7 is NO, the difference between Tw+α and To is always equal to or greater than zero. The execution of the feedback control referring to this map regulates the temperature To of the lubricating oil within a proper range. The determination at step S7 also becomes NO when $T_0$ is less than Tw, and step S8 is executed. When $T_0$ is less than Tw, in the map illustrated in FIG. 5, the value of the horizontal axis represents − (minus), but as the value of the horizontal axis decreases, the flow control valve open degree decreases. As the flow control valve open degree decreases, the heat exchange between the coolant and the lubricating oil is reduced, and the situation in which the heat of the coolant is removed by the lubricating oil is improved.

After the open degree of the flow control valve 32*a* is adjusted at step S8, the process moves to step S9. At step S9, it is determined whether the internal-combustion engine 10 has stopped. This process is a condition for ending the sequence of control. When the determination at step S9 is NO, the processes from step S1 are repeated, while when the determination at step S9 is YES, the sequence of processes is ended (END).

On the other hand, when the determination at step S1 is YES, the process moves to step S11. That is, when both the rotation speed NE of the internal-combustion engine 10 and the temperature Tw of the coolant meet the predetermined conditions, the process moves to step S11. At step S11, it is determined whether the state where the rotation speed NE of the internal-combustion engine is greater than the high-rotation determination threshold value NE1 and the temperature Tw of the coolant is greater than the warm-up determination temperature Tw1 continues for t1 seconds. Here, the timer 28*a* measures t1 seconds. The timer 28*a* starts measuring the time when the rotation speed NE exceeds the high-rotation determination threshold value NE1 and the temperature Tw exceeds the warm-up determination temperature Tw1. The length of time t1 can be appropriately determined. The reason why the passage of t1 seconds is required is for stable control. The determination at step S11 determines the switching condition between the ebullient cooling and the liquid cooling. Thus, if the cooling state is changed even when the rotation speed NE of the internal-combustion engine slightly exceeds the high-rotation determination threshold value NE1, the switching frequency of the control increases, and stable control is not achieved.

Figure 6:
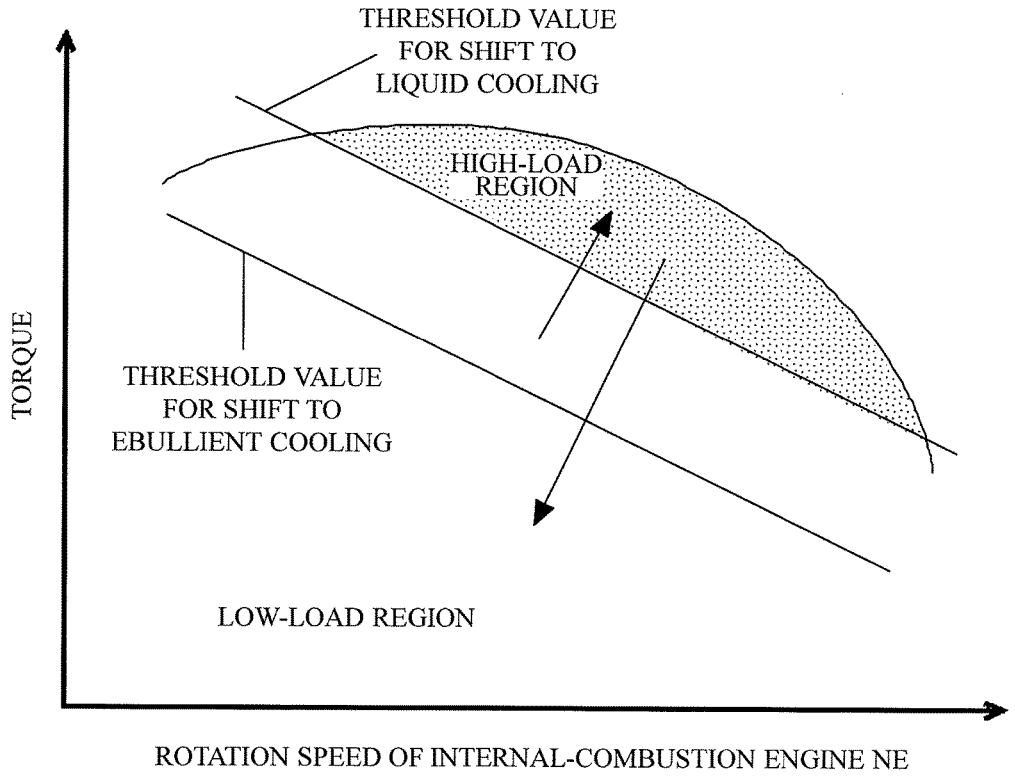
FIG. 6 illustrates a map that is referred to when ebullient cooling is switched to liquid cooling.

When the determination at step S11 is NO, the process moves to step S2, and the processes after step S2 are executed. The processes from step S2 are already described, and thus the description thereof is omitted. On the other hand, when the determination at step S11 is YES, the process moves to step S12. The process of step S12 is the same as the process of step S5. That is, at step S12, the cooling state is switched to the liquid cooling state. As described above, when the internal-combustion engine 10 is in the high-rotation state, the second three-way valve 33*a* corresponding to the control valve is switched to the state where the passage leading to the coolant passage 12 formed inside the internal-combustion engine 10 is opened. In the present embodiment, although the cooling state is switched to the liquid cooling when the internal-combustion engine 10 is in the high-rotation state where the internal-combustion engine 10 maintains its rotation speed at the high-rotation determination threshold value NE1 or greater, the cooling state may be switched to the liquid cooling when the internal-combustion engine 10 is in the high-load state. In this case, a map illustrated in FIG. 6 is referred to, and the cooling state is switched to the liquid cooling when the loading state of the internal-combustion engine 10 exceeds a threshold value for shift to liquid cooling and enters a high-load region, and this state is kept for a predetermined period of time. This control stops the operation of the Rankine cycle, and performs the liquid cooling in the internal-combustion engine 10 and the oil cooler (EOC) 30 that is a heat exchanger. While the Rankine cycle is stopped, the pressure of the coolant decreases, and the boiling point also decreases. Thus, the temperature of the coolant also decreases, and the lubricating oil, which is a cooling object, can be appropriately cooled.

After the process of step S12 is ended, the process moves to step S13. At step S13, it is determined whether a state where the rotation speed NE of the internal-combustion engine 10 is equal to or less than a low-rotation determination threshold value NE2 continues for t2 seconds. Here, NE1 is greater than NE2. The timer 28*a* measures t2 seconds. The timer 28*a* starts measuring the time when the rotation speed NE falls below the low-rotation determination threshold value NE2. The length of time t2 can be appropriately determined. The reason why the passage of t2 seconds is required is for stable control as the passage of t1 seconds is required when the determination for the high-rotation determination threshold value NE1 is made. To switch the cooling state depending on the loading state of the internal-combustion engine 10, the map illustrated in FIG. 6 is referred to, and the cooling state is switched to the ebullient cooling when the loading state of the internal-combustion engine 10 exceeds a threshold value for shift to ebullient cooling and enters a low-load region from the high-load region and this state continues for a predetermined period of time.

When the determination at step S13 is NO, the processes from step S12 are repeated. When the determination at step S13 is YES, the process moves to step S14. At step S14, the cooling state is returned to the ebullient cooling state. The specific process at step S14 is the same as the process at step S4, and thus the detailed description thereof is omitted.

After the process at step S14, the processes from step S6 are executed. The processes after step S6 are already described, and thus the detailed description thereof is omitted.

As described above, the ebullient cooling device 100 of the present embodiment can appropriately cool the lubricating oil that is a cooling object to be cooled by heat exchange with the coolant that cools the internal-combustion engine 10. Since the ebullient cooling device 100 of the present embodiment can cool the lubricating oil by ebullient cooling, it is possible to control the temperature of the lubricating oil to be less than the temperature of the coolant circulating in the internal-combustion engine 10 if necessary. When the lubricating oil is cooled by heat exchange with the coolant, the temperature of the lubricating oil cannot be decreased to less than the temperature of the coolant. Thus, making the temperature of the lubricating oil less than that of the coolant by using ebullient cooling is the advantage of the ebullient cooling device 100 of the present embodiment.

The configuration in which the second three-way valve 33*a* is eliminated and the oil cooler 30 is always coupled to the condenser 24 may be taken. In this case, the flow control valve 32*a* is fully closed even while the internal-combustion engine 10 is warmed up. Such a configuration discards the effect of increasing the temperature of the lubricating oil by the coolant during warm-up, but the configuration of the ebullient cooling device 100 can be simplified.

While the exemplary embodiments of the present invention have been illustrated in detail, the present invention is not limited to the above-mentioned embodiments, and other embodiments, variations and variations may be made without departing from the scope of the present invention.

DESCRIPTION OF LETTERS OR NUMERALS

10 internal-combustion engine
12 coolant passage (water jacket)
13 first passage
14 gas-liquid separator
14*a* steam outlet
14*b* first liquid-phase coolant outlet
14*c* second liquid-phase coolant outlet
14*d* fluid level sensor
14*e* outlet
15 second steam pathway
15*a* first on-off valve
16 superheater
18 turbine (expander)
20 exhaust heat steam generator
24 condenser
27*a* second water pump
28 ECU
28*a* timer
32*a* flow control valve
33 thirteenth passage
33*a* second three-way valve

The invention claimed is:

1. An ebullient cooling device comprising:

a coolant passage configured to be formed inside an internal-combustion engine, and to allow a coolant that cools the internal-combustion engine by boiling to flow therethrough;

an expander configured to be driven by the coolant that has boiled in the internal-combustion engine;

a condenser configured to be located at a downstream side of the expander, and to cool the coolant that has passed through the expander;

an oil cooler configured to cool a cooling object by heat exchange with the coolant;

and a control valve, wherein a low-pressure region including the expander and the condenser and a high-pressure region other than the low-pressure region are formed in a path through which the coolant circulates, a passage connecting to a part through which a liquid-phase coolant flows and a passage connecting to the low-pressure region are coupled to the oil cooler, a passage is configured to diverge from the passage connecting to the low-pressure region and to be communicated with the coolant passage formed inside the internal-combustion engine, and the control valve is configured to switch between a state where a passage leading to the low-pressure region is opened to permit the oil cooler to operate in an ebullient cooling state and a state where a passage leading to the coolant passage formed inside the internal-combustion engine is opened to permit the oil cooler to operate in a liquid cooling state, the control valve being located in a point at which the passage diverges from the passage connecting to the low-pressure region.

2. The ebullient cooling device of claim 1, further comprising a flow control valve configured to adjust an amount of the liquid-phase coolant that flows through the passage coupled to the oil cooler and the part through which the liquid-phase coolant flows, the flow control valve being located in the passage.

3. The ebullient cooling device of claim 1, wherein the control valve is switched to the state where the passage leading to the coolant passage formed inside the internal-combustion engine is opened during warm-up of the internal-combustion engine.

4. The ebullient cooling device of claim 1, wherein the control valve is switched to the state where the passage leading to the coolant passage formed inside the internal-combustion engine is opened when the internal-combustion engine is in a high-rotation state or a high-load state.

5. The ebullient cooling device of claim 1, further comprising:

a bypass passage configured to diverge from a path connecting the coolant passage formed inside the internal-combustion engine and the expander, and to bypass the expander and connect to the condenser; and a control valve configured to switch between a state where a passage leading to the expander is opened and a state where the bypass passage is opened, the control valve being located at a point at which the bypass passage diverges from the path connecting the coolant passage and the expander.

* * * * *